US006827295B1

(12) United States Patent
Hendren et al.

(10) Patent No.: US 6,827,295 B1
(45) Date of Patent: Dec. 7, 2004

(54) HIGH PRESSURE MISTING NOZZLE WITH A FREELY MOVABLE NOZZLE PIN

(75) Inventors: Sidney Rhyne Hendren, Lancaster, PA (US); Kenneth Eugene Parsons, Strasburg, PA (US)

(73) Assignee: VAL Products, Inc., Bird-In-Hand, PA (US)

( * ) Notice: Subject to any disclaimer, the term of this patent is extended or adjusted under 35 U.S.C. 154(b) by 0 days.

(21) Appl. No.: 09/337,529

(22) Filed: Jun. 22, 1999

(51) Int. Cl.[7] ..... B05B 3/04

(52) U.S. Cl. ..... 239/381; 239/382; 239/571; 239/533.15

(58) Field of Search ..... 239/381, 382, 239/380, 571, 533.15, 533.1; 267/179; 119/436, 448

(56) References Cited

U.S. PATENT DOCUMENTS

| | | | | | |
|---|---|---|---|---|---|
| 1,881,409 | A | | 10/1932 | Le Moon | |
| 2,563,300 | A | | 8/1951 | Aker | |
| 2,568,429 | A | | 9/1951 | Burnam et al. | |
| 2,571,763 | A | | 10/1951 | Robbins | |
| 2,643,915 | A | * | 6/1953 | Pieroni | 239/571 |
| 3,033,467 | A | | 5/1962 | Hofer | |
| 3,147,924 | A | * | 9/1964 | Schulze | 239/533.15 |
| 3,347,463 | A | | 10/1967 | Baker | |
| 3,889,881 | A | * | 6/1975 | Cunningham et al. | 239/533.1 |
| 4,625,915 | A | | 12/1986 | Cockman | |
| 4,925,111 | A | | 5/1990 | Foertsch et al. | |
| 5,004,157 | A | | 4/1991 | Martell | |
| 5,415,348 | A | | 5/1995 | Nelson | |
| 5,492,082 | A | * | 2/1996 | Krevinghaus et al. | 119/448 |
| 5,857,626 | A | * | 1/1999 | Hsu | 239/381 |
| 5,927,611 | A | * | 7/1999 | Palestrant | 239/381 |
| 6,000,636 | A | * | 12/1999 | Huang | 239/381 |

* cited by examiner

*Primary Examiner*—Steven J. Ganey
(74) *Attorney, Agent, or Firm*—Troxell Law Office PLLC

(57) ABSTRACT

A high pressure misting nozzle is disclosed having a nozzle stem body with a fluid inlet and a first chamber in communication with the fluid inlet, a fogger nozzle attached to the nozzle stem body, the fogger nozzle having a nozzle orifice and a second chamber in communication with the nozzle orifice and the first chamber, a valve member movably located in the first chamber and movable between a closed position preventing fluid communication between the fluid inlet and the first chamber, and an open position which allows fluid communication between the fluid inlet and the first chamber, and a nozzle pin movably located in the second chamber, the nozzle pin having fluid metering notches and being freely movable between a first position in which it is displaced away from the nozzle orifice, and a second position in which it is located adjacent to the nozzle orifice, the fluid entering the second chamber urging the nozzle pin toward the second position. When the nozzle pin is in the second position, the fluid metering notches control the flow of fluid through the nozzle orifice to achieve optimum atomization of the fluid.

15 Claims, 4 Drawing Sheets

FIG.5
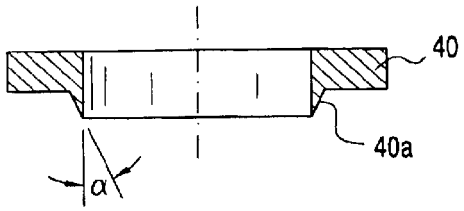
FIG.4
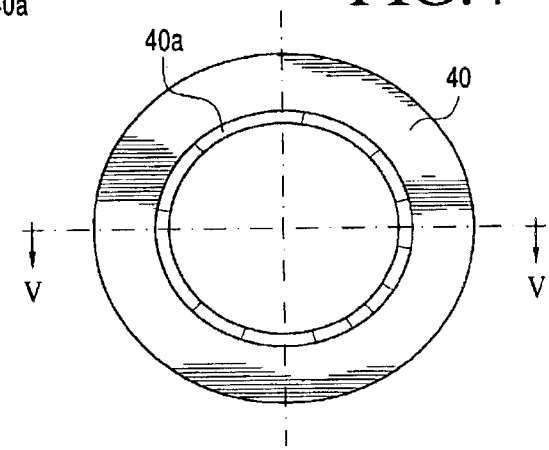
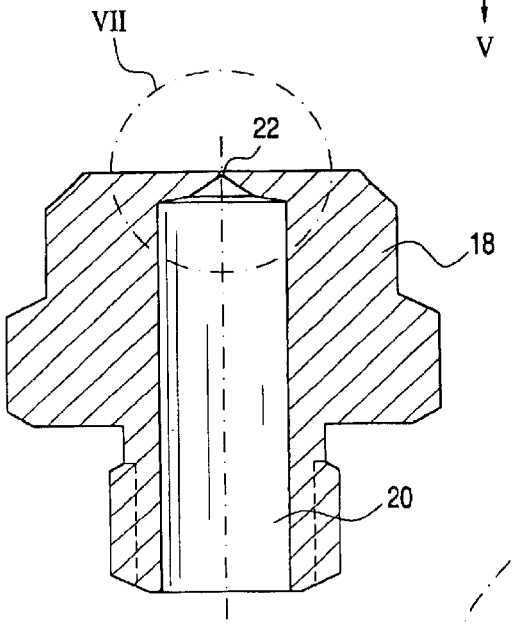
FIG.6
FIG.7
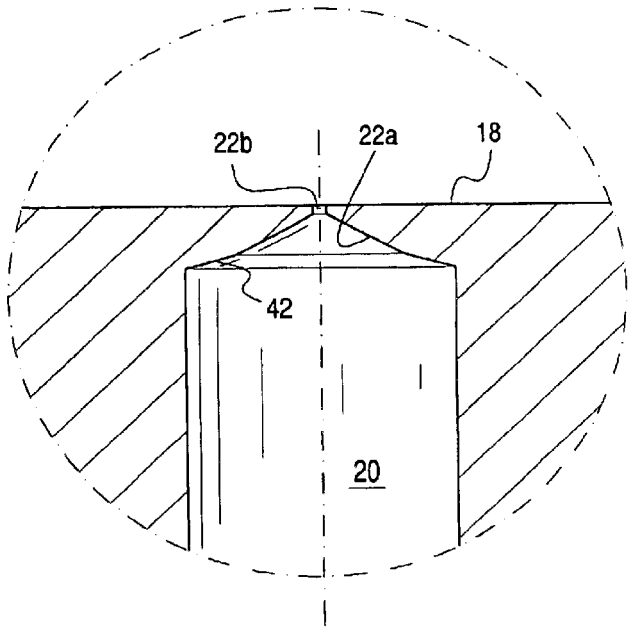

HIGH PRESSURE MISTING NOZZLE WITH A FREELY MOVABLE NOZZLE PIN

BACKGROUND OF THE INVENTION

The present invention relates to a misting nozzle for atomizing a fluid, such as water, more particularly such a nozzle in which a nozzle pin is freely movable relative to a nozzle orifice.

Fogging or misting nozzles are known for atomizing fluids and typically have a nozzle with a nozzle orifice in communication with a source of pressurized fluid. A nozzle pin may be fixed within the nozzle located adjacent to the nozzle orifice, the nozzle pin having one or more openings or grooves to meter the amount and pressure of fluid passing through the nozzle orifice. By controlling the volume and pressure of the fluid passing through the nozzle orifice, a desired atomization of the fluid can be achieved.

While generally successful, the known misting nozzles are subject to becoming clogged, especially when the atomized fluid is water from municipalities and private wells. Due to the small dimensions of the nozzle orifice and the nozzle pin, the water flow passages or openings become easily clogged with scale, dirt, etc. which may be present in the water. Since the nozzle pin is fixedly mounted in the nozzle, when such clogging occurs the only recourse is to replace the complete nozzle.

During the use of such misting nozzles, it may become desirable to vary the fluid flow through the nozzle. However, in the known misting nozzles, the nozzle flow is fixed due to the fixed nozzle orifice and the fixed nozzle pin. The fluid flow through the nozzle can only be varied by substituting a different nozzle having a different nozzle orifice size and/or a different nozzle pin. This requires a user to have a multiplicity of nozzles on hand causing increased operating costs and undue complexity for the misting nozzle system.

SUMMARY OF THE INVENTION

The present invention relates to a high pressure misting nozzle which overcomes the problems of the known misting nozzles by providing a nozzle pin that is freely movable within the nozzle and which may be removed from the nozzle for cleaning. The nozzle pin may also be replaced with another nozzle pin having different-sized fluid metering passages to thereby enable the user to vary the fluid flow through the nozzle without replacing the entire nozzle assembly.

A high pressure misting nozzle is disclosed having a nozzle stem body with a fluid inlet and a first chamber in communication with the fluid inlet, a fogger nozzle attached to the nozzle stem body, the fogger nozzle having a nozzle orifice and a second chamber in communication with the nozzle orifice and the first chamber, a valve member movably located in the first chamber and movable between a closed position preventing fluid communication between the fluid inlet and the first chamber, and an open position which allows fluid communication between the fluid inlet and the first chamber, and a nozzle pin movably located in the second chamber, the nozzle pin having fluid metering notches and being freely movable between a first position in which it is displaced away from the nozzle orifice, and a second position in which it is located adjacent to the nozzle orifice, the fluid entering the second chamber urging the nozzle pin toward the second position. When the nozzle pin is in the second position, the fluid metering notches control the flow of fluid through the nozzle orifice to achieve optimum atomization of the fluid.

When the nozzle is connected to a fluid supply pipe or tube and the fluid pressure is below a predetermined level, the valve member will be located in its closed position, thereby preventing fluid from entering the first and second chambers of the nozzle assembly. The nozzle pin will also rest in the first position in which it is displaced away from the nozzle orifice. When the fluid pressure reaches or exceeds the predetermined pressure, the fluid pressure acting on the valve member moves it to its open position, thereby allowing fluid to enter the first and second chambers. The fluid entering the second chamber moves the nozzle pin to the second position in which it is located adjacent to the nozzle orifice in which it can meter the fluid flow through the nozzle orifice.

The present invention also encompasses a high pressure misting system utilizing a nozzle according to the afore-described construction connected to a length of tubing which, in turn, is connected to a fluid supply. Such a misting system can be utilized to cool an interior of an enclosure by locating the length of tubing and the associated nozzles either within the interior of the enclosure, or by locating the tubing and the nozzles adjacent to an opening through which air is drawn into the enclosure. By spraying atomized water into the air in the enclosure, or air being drawn into the enclosure, the evaporation of the water droplets will cool the air.

BRIEF DESCRIPTION OF THE DRAWINGS

FIG. 4 is a bottom plan view of a flange tube seal utilized with the present invention.

FIG. 5 is a cross-sectional view taken along line V—V in FIG. 4.

FIG. 6 is a cross-sectional View of a fogger nozzle according to the present invention.

FIG. 7 is an enlarged, cross-sectional view of the area VII in FIG. 6.

DESCRIPTION OF THE PREFERRED EMBODIMENTS OF THE INVENTION

Figure 1:
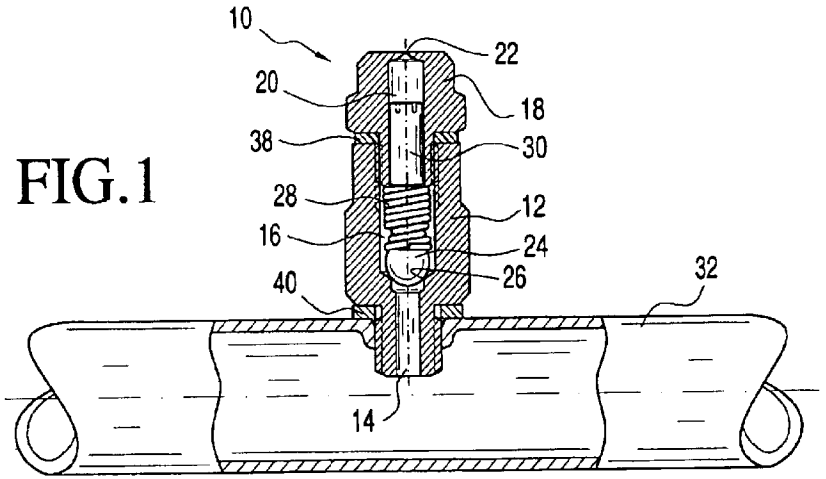
FIG. 1 is a cross-sectional view of the nozzle according to the present invention with the movable nozzle pin in a first position.
Figure 2:
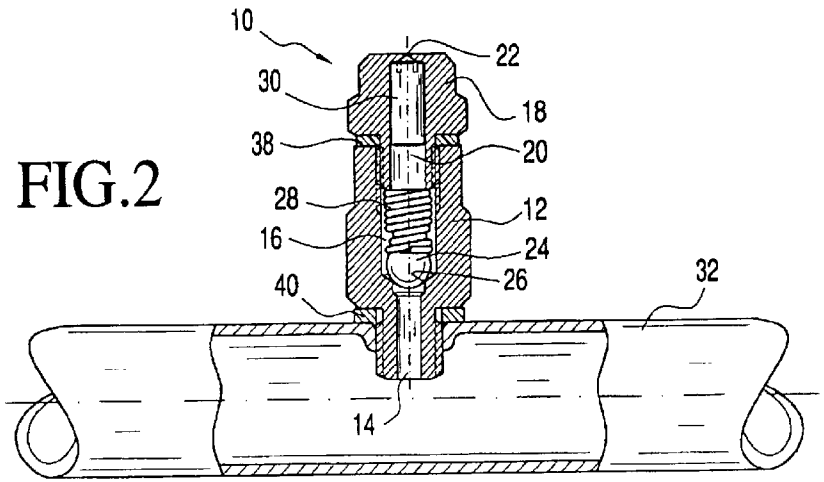
FIG. 2 is a cross-sectional view similar to FIG. 1, but illustrating the nozzle pin in a second position.

The misting nozzle 10 according to the present invention, as illustrated in FIGS. 1 and 2, comprises a nozzle stem body 12 having a fluid inlet 14 and a chamber 16, with a fogger nozzle 18 attached to the nozzle stem body 12, the fogger nozzle 18 having a chamber 20 therein which is in communication with a nozzle orifice 22. The fogger nozzle 18 is removably attached to the nozzle stem body 12. Although a threaded connection between these elements is illustrated in the figures, it is to be understood that other means may be utilized to removably connect the fogger nozzle 18 to the nozzle stem body 12.

A valve member 24 is located within the chamber 16 and is biased into the closed position, illustrated in FIG. 1, against a valve seat 26 by a spring 28. Spring 28 comprises a compression coil spring having one end bearing on the valve member 24, in this particular instance a spherical ball valve, and the other end bearing against a lower portion of the fogger nozzle 18 which is threaded into the nozzle stem body 12. Although a spherical ball valve is disclosed, it is to be understood that other types of valves may be utilized without exceeding the scope of this invention. A free-floating nozzle pin 30 is located within the chamber 20 and, when the valve member 24 is in the closed position illustrated in FIG. 1, the nozzle pin 30 will rest on a top portion of spring 28.

When the fluid within tube 32, to which the misting nozzle 10 is attached and with which the fluid inlet 14 communicates, reaches or exceeds a predetermined pressure, the fluid pressure will counteract the biasing force of the coil spring 28 and move the valve element 24 away from the valve seat 26, as illustrated in FIG. 2. This enables the fluid to enter the chambers 16 and 20, and act on the nozzle pin 30 to move the nozzle pin 30 to the second position illustrated in FIG. 2, in which a metering portion of the nozzle pin 30, to be described in more detail hereinafter, is adjacent to the nozzle orifice 22. Clearance between the side surface of the nozzle pin 30 and the wall bounding the side of the chamber 20 enables fluid to pass around the nozzle pin 30, through metering notches in the metering portion and out through the nozzle orifice 22, thus atomizing the fluid. Lubrication is provided by the fluid passing between the wall and the nozzle pin so that wear on the pin is minimal and, in some cases, nonexistent. As long as the fluid pressure within the tube 32 exceeds a predetermined, opening pressure for the valve member 24, the nozzle will continue to function as a atomizing, misting nozzle with the elements in the positions illustrated in FIG. 2.

Figure 3:
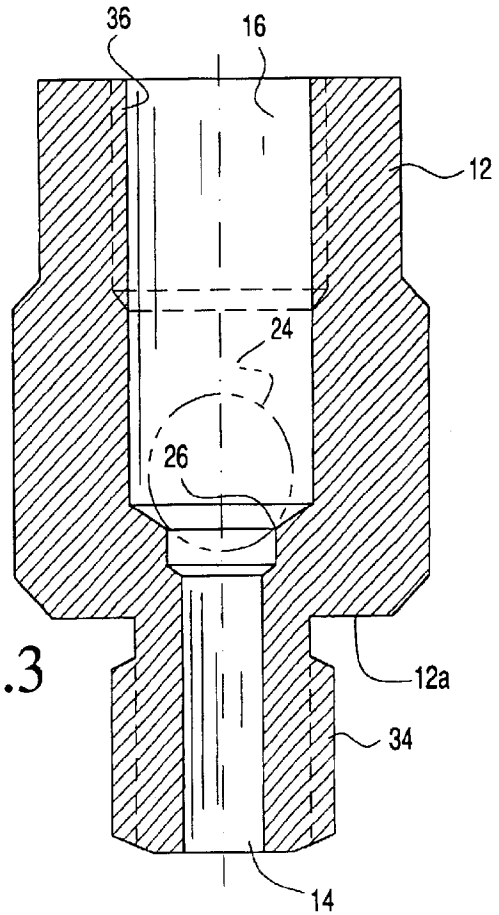
FIG. 3 is a cross-sectional view of the nozzle stem body according to the present invention.

The nozzle stem body is illustrated in cross-section in FIG. 3, wherein it can be seen that the inlet 14 communicates with the chamber 16 when the valve element 24 has been displaced from the valve seat 26. A lower portion of the nozzle stem body 12 has external threads 34 thereon for engagement with the tube 32. Internal threads 36 are located in an upper portion of the chamber 16 and engage corresponding threads formed on the nozzle 18 to removably attach these elements together.

A seal or gasket 38 may be utilized between the fogger nozzle 18 and the nozzle stem body 12 to prevent any fluid leakage at their junction. Similarly, a flange tube seal 40, illustrated in detail in FIGS. 4 and 5, may be utilized between an outer surface of the tube 32 and the radial surface 12*a* on the nozzle stem body 12 to prevent fluid leakage at the juncture between the stem body 12 and the tube 32. As can be seen in FIGS. 4 and 5, the tube seal 40 has a flange 40*a* extending from the side which bears against the outer surface of the tube 32. The flange 40*a* has an outer surface inclined at an angle $\alpha$ with respect to the inner surface which forms a boundary of the center hole through the tube seal. The angle $\alpha$ may be on the order of 25° or the like. Typically, when attaching such nozzles to a tube 32, there may be a slight deformation in the outer surface of the tube around the hole in which the nozzle 10 is attached. The flange 40*a* fits into the deformation and prevents any fluid leakage around this deformed area.

Figure 8:
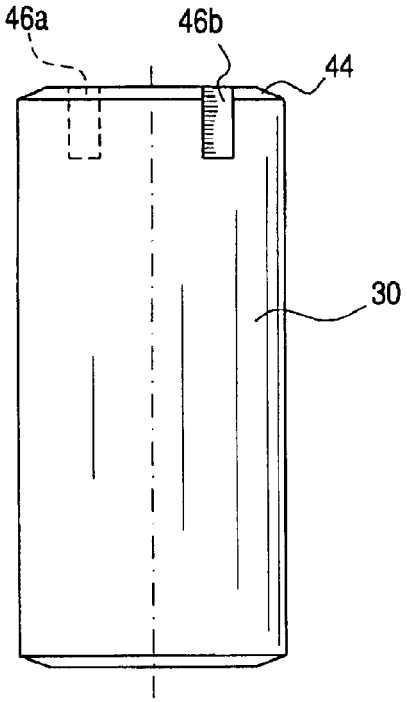
FIG. 8 is a side view of the nozzle pin according to the present invention.
Figure 9:
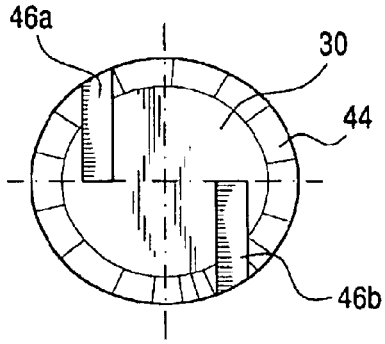
FIG. 9 is a top plan view of the nozzle pin of FIG. 8.
Figure 10:
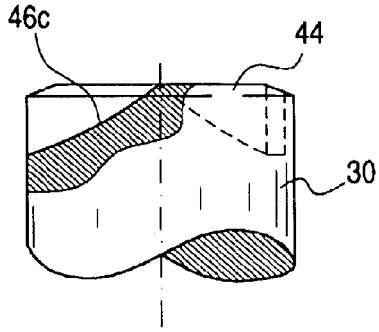
FIG. 10 is a partial, enlarged side view of the nozzle pin illustrated in FIGS. 8 and 9, partially broken away.

The fogger nozzle 18 is illustrated in more detail in FIGS. 6 and 7. As can be seen, the fogger nozzle 18 has second chamber 20 which communicates with the nozzle orifice 22 and first chamber 16. Nozzle orifice 22, as best illustrated in FIG. 7, comprises a conical portion 22*a* which communicates with a smaller diameter, cylindrical portion 22*b*. Nozzle orifice 22 is located in an upper portion the fogger nozzle 18 as is contact surface 42. The angle and size of the contact surface 42 matches the angle and size of the contact surface 44 located on an upper portion of the nozzle pin 30, as best illustrated in FIGS. 8-10.

The nozzle pin 30 is generally cylindrical in configuration and has a metering portion at one end thereof, on which is located the contact surface 44. The metering portion comprises one or more metering notches 46*a* and 46*b* which extend generally in a chordal direction from a periphery of the nozzle pin 30 through the contact surface 44, to a common diametrical line, as best seen in FIG. 9. Notches 46*a* and 46*b* are spaced apart along the diametrical line and extend substantially parallel to each other, perpendicular to the common diametrical line. As best seen in FIG. 10, the base of each of the notches 46*a* and 46*b* may comprise an arcuate surface 46*c*.

When the nozzle pin 30 is in the position adjacent to the nozzle orifice 22, as illustrated in FIG. 2, the contact between the contact surfaces 44 and 42 prevents any of the fluid from entering the conical portion 22*a* of the nozzle orifice except through the metering notches 46*a* and 46*b*. The contact surfaces 42, 44 have complementary configurations to ensure maximum contact area so as to prevent fluid flow between these surfaces. Any complementary configurations may be used, although conical configurations are preferred. The included angle between the opposite sides of the conical contact surfaces 42 and 44 is on the order of 150°. The dimensions of the metering notches enable the user to achieve the desired fluid flow rate through the nozzle assembly to achieve maximum atomization of the fluid.

If a different flow rate is desired by the user, the fogger nozzle 18 may be readily removed from the nozzle stem body 12, the existing nozzle pin 30 removed, a new nozzle pin 30 inserted therein and the nozzle re-assembled. The new nozzle pin may have different sized or shaped metering notches to achieve the desired fluid flow rate. The diameter of the nozzle pin 30 is less than the diameter of the chamber 20 thereby enabling the nozzle pin 30 to freely move in the chamber 20 and the fluid to flow from the chamber 16, through the chamber 20 around the outer surface of the nozzle pin 30 and through the metering notches 46.

Figure 11:
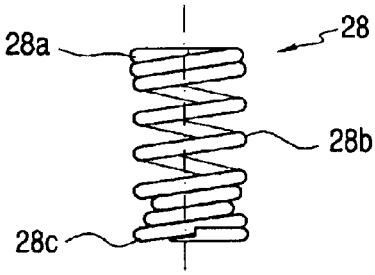
FIG. 11 is a side view of a coil spring utilized with the valve member according to the present invention.
Figure 12:
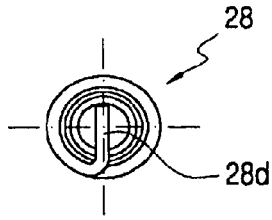
FIG. 12 is a top view of the coil spring illustrated in FIG. 11.

FIGS. 11 and 12 illustrate the coil spring 28 utilized with the valve member 24. Coil spring 28 is a compression-type coil spring having an upper end portion 28*a*, a middle portion 28*b* and a lower end portion 28*c*. The upper end portion 28*a* has a cross member 28*d* which extends at least partially across the diameter of the upper end portion as best illustrated in FIG. 12. The cross-member supports the nozzle pin 30 when the valve member 24 is in the closed position, as illustrated in FIG. 1. The diameters of the spring coils in the middle portion 28*b* are less than corresponding diameters of the end portions 28*a* and 28*c*. Also, the longitudinal spacing between adjacent coils is greater in the middle portion 28*b* than at either of the end portions 28*a* and 28*c*.

Quite obviously, the coil diameter of end portion 28*c* should be sized so as to extend over a portion of the spherical ball valve element 24 so that a proper closing biasing force may be exerted on the valve member by the coil spring.

Figure 13:
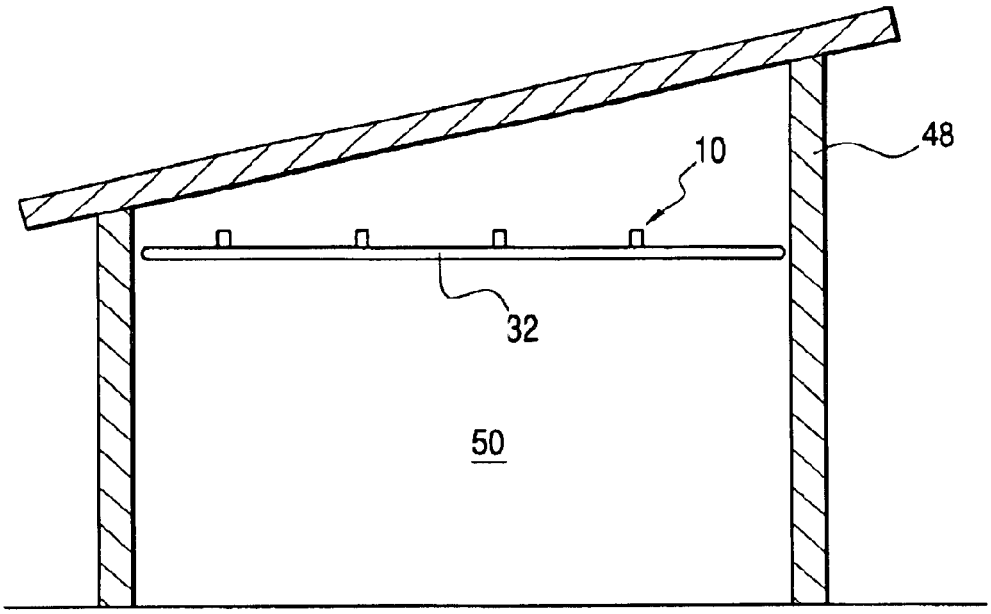
FIG. 13 is a cross-sectional view illustrating the use of the misting system according to the present invention located within an interior of an enclosure to cool the air within the enclosure.
Figure 14:
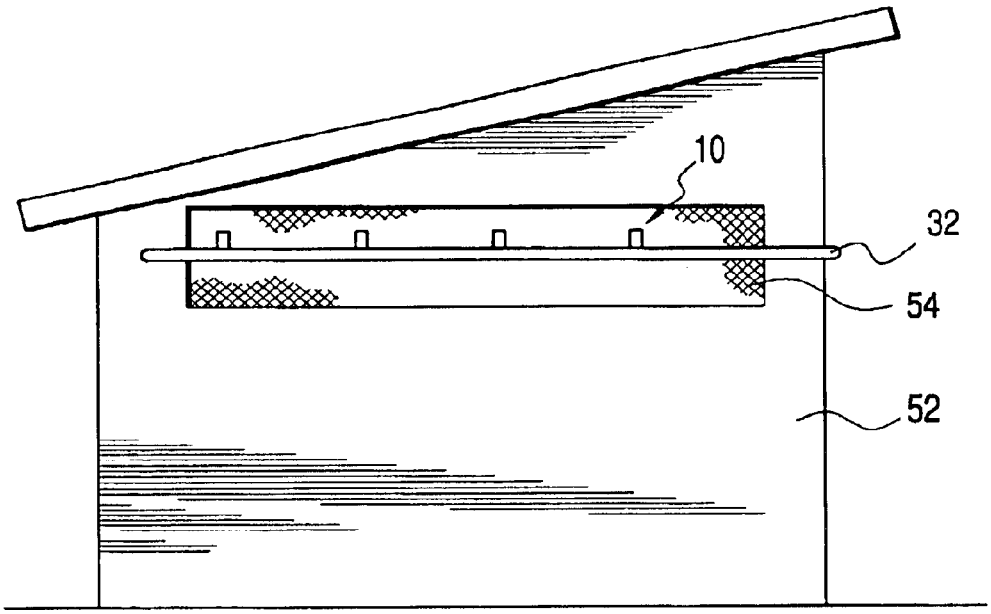
FIG. 14 is a side view of an enclosure having the misting system according to the present invention located exteriorly of the enclosure adjacent to an ambient air intake opening.

As noted previously, the misting nozzle according to the present invention may be utilized in a cooling system to cool the interior of an enclosure using evaporative cooling. As illustrated in FIG. 13, the enclosure 48 has an interior 50 in which is located the tubing 32 having a plurality of misting nozzles 10 mounted thereon. The tubing 32 is connected to a source of fluid (not shown) which may be pumped into and through the tube 32. When cooling of the interior 50 is desired, the fluid is pumped into the tubing 32 and the atomized fluid exits each of the plurality of nozzles 10 in a fine mist. The fine mist readily evaporates in the air in the interior 50, thereby cooling the air by evaporative cooling. The mist droplets should be sufficiently fine that no fluid reaches the bottom surface of the interior 50 in liquid form.

The evaporative cooling system can also be utilized on the exterior of an enclosure 52 which has an opening 54 through which ambient air is drawn into the interior of the enclosure 50. The opening 54 may be protected by a screen or the like and the tube 32 is located adjacent to the exterior of the opening 54. Again, a plurality of misting nozzles 10 are mounted on the tube 32. As in the previously described fashion, fluid pumped through the tube 32 is atomized by nozzles 10, the atomized droplets evaporating in the air to cool the air as it enters the opening 54.

The foregoing description is provided for illustrative purposes only and should not be construed as in anyway limiting this invention, the scope of which is defined solely by the appended claims.

What is claimed is:

1. A high pressure misting nozzle comprising:

a) a nozzle stem body having a fluid inlet and a first chamber in communication with the fluid inlet;

b) a fogger nozzle attached to the nozzle stem body, the fogger nozzle having a nozzle orifice and a second chamber in communication with the nozzle orifice and the first chamber;

c) a valve member movably located in the first chamber and movable between a closed position preventing fluid communication between the fluid inlet and the first chamber, and an open position allowing fluid communication between the fluid inlet and the first chamber whereby fluid may enter the first and second chambers;

d) a nozzle pin having a longitudinal axis removably located in the second chamber, the nozzle pin having a fluid metering portion and being movable along the longitudinal axis between a first position in which the nozzle pin is displaced away from the nozzle orifice, and a second position in which the nozzle pin is located adjacent to the nozzle orifice, whereby fluid entering the second chamber urges the nozzle pin toward the second position, the nozzle pin being generally cylindrical in configuration having first and second ends, and wherein the fluid metering portion comprises at least one fluid metering notch located in the first end; and, e) a helical coil spring acting on the valve member, the helical coil spring having a first end with a cross member extending at least partially along a diameter of the helical coil spring, whereby the nozzle pin rests on the cross member when in the first position.

2. The high pressure misting nozzle of claim 1, wherein the fogger nozzle is removably attached to the nozzle stem.

3. The high pressure misting nozzle of claim 1, further comprising a plurality of spaced apart fluid metering notches.

4. The high pressure misting nozzle of claim 3, comprising two spaced apart fluid metering notches, each fluid metering notch extending in a chordal direction, each fluid metering notch being substantially perpendicular to a common diametrical line.

5. The high pressure nozzle of claim 1, further comprising:

a) a first contact surface on the fogger nozzle adjacent to the nozzle orifice; and, b) a second contact surface on the metering portion of the nozzle pin having a configuration complementary to the first contact surface and located so as to contact the first contact surface when the nozzle pin is in the second position whereby fluid in the second chamber must pass through the at least one fluid metering notch before reaching the nozzle orifice.

6. The high pressure misting nozzle of claim 5, wherein the at least one fluid metering notch passes through the second contact surface.

7. The high pressure misting nozzle of claim 5, wherein the first and second contact surfaces have substantially conical configurations.

8. The high pressure misting nozzle of claim 1, wherein the valve member comprises a ball valve.

9. The high pressure misting nozzle of claim 8, further comprising a ball valve seat located in the first chamber contacted by the ball valve when the ball valve is in the closed position.

10. The high pressure misting nozzle of claim 1, wherein the nozzle orifice comprises a substantially conical portion in communication with the second chamber and a substantially cylindrical portion in communication with the conical portion.

11. A high pressure misting nozzle comprising:

a) a nozzle stem body having a fluid inlet and a first chamber in communication with the fluid inlet;

b) a fogger nozzle attached to the nozzle stem body, the fogger nozzle having a nozzle orifice and a second chamber in communication with the nozzle orifice and the first chamber;

c) a valve member movably located in the first chamber and movable between a closed position preventing fluid communication between the fluid inlet and the first chamber, and an open position allowing fluid communication between the fluid inlet and the first chamber whereby fluid may enter the first and second chambers; and, d) a nozzle pin having a longitudinal axis removably located in the second chamber, the nozzle pin having a fluid metering portion and being movable along the longitudinal axis between a first position in which the nozzle pin is displaced away from the nozzle orifice, and a second position in which the nozzle pin is located adjacent to the nozzle orifice, whereby fluid entering the second chamber urges the nozzle pin toward the second position; and e) a coil spring acting on the valve member;

wherein the coil spring has opposite end portions and a middle portion wherein a longitudinal spacing between the adjacent helical coils in the middle portion is greater than a longitudinal spacing between adjacent helical coils in each of the opposite end portions.

12. The high pressure misting nozzle of claim 11, wherein the opposite end portions of the coil spring have coil diameters greater than a coil diameter of the middle portion.

13. A high pressure misting system comprising:

a) a length of tubing connected to a fluid supply; and, b) at least one high pressure misting nozzle connected to the length of tubing, the at least one high pressure misting nozzle comprising:

i) a nozzle stem body having a fluid inlet and a first chamber in communication with the fluid inlet;

ii) a fogger nozzle attached to the nozzle stem body, the fogger nozzle having a nozzle orifice and a second chamber in communication with the nozzle orifice and the first chamber;

iii) a valve member movably located in the first chamber and movable between a closed position preventing fluid communication between the fluid inlet and the first chamber, and an open position allowing fluid communication between the fluid inlet and the first chamber, whereby fluid may enter the first and second chambers; and, iv) a nozzle pin having a longitudinal axis and removably located in the second chamber, the nozzle pin having a fluid metering portion and being movable along the longitudinal axis between a first position in which the nozzle pin is displaced away from the nozzle orifice, and a second position in which the nozzle pin is located adjacent to the nozzle orifice, whereby fluid entering the second chamber urges the nozzle pin toward the second position, the nozzle pin being generally cylindrical in configuration having first and second ends, and wherein the fluid metering portion comprises at least one fluid metering notch located in the first end, such that, when fluid within the tubing reaches a predetermined pressure, the valve member moves to the open position, the fluid within the second chamber moving the nozzle pin to the second position such that the fluid is atomized as it passes through the nozzle orifice; and, v) a helical coil spring acting on the valve member, the helical coil spring having a first end with a cross member extending at least partially along a diameter of the helical coil spring, whereby the nozzle pin rests on the cross member when in the first position.

14. A cooling system for cooling an interior of an enclosure comprising:

a) a length of tubing located within the enclosure, the length of tubing connected to a fluid supply; and, b) at least one high pressure misting nozzle connected to the length of tubing, the at least one high pressure misting nozzle comprising:

i) a nozzle stem body having a fluid inlet and a first chamber in communication with the fluid inlet;

ii) a fogger nozzle attached to the nozzle stem body, the fogger nozzle having a nozzle orifice and a second chamber in communication with the nozzle orifice and the first chamber;

iii) a valve member movably located in the first chamber and movable between a closed position preventing fluid communication between the fluid inlet and the first chamber, and an open position allowing fluid communication between the fluid inlet and the first chamber, whereby fluid may enter the first and second chambers;

iv) a nozzle pin having a longitudinal axis and removably located in the second chamber, the nozzle pin having a fluid metering portion and being movable along the longitudinal axis between a first position in which the nozzle pin is displaced away from the nozzle orifice, and a second position in which the nozzle pin is located adjacent to the nozzle orifice, whereby fluid entering the second chamber urges the nozzle pin toward the second position, the nozzle pin being generally cylindrical in configuration having first and second ends, and wherein the fluid metering portion comprises at least one fluid metering notch located in the first end, such that, when fluid within the tubing reaches a predetermined pressure, the valve member moves to the open position, the fluid within the second chamber moving the nozzle pin to the second position such that the fluid is atomized as it passes through the nozzle orifice, the evaporation of the atomized fluid cooling the air within the enclosure; and, v) a helical coil spring acting on the valve member, the helical coil spring having a first end with a cross member extending at least partially along a diameter of the helical coil spring, whereby the nozzle pin rests on the cross member when in the first position.

15. A cooling system for cooling an interior of an enclosure, the enclosure having an air inlet opening through which air enters the enclosure, the system comprising:

a) a length of tubing located adjacent to the air inlet opening, the length of tubing connected to a fluid supply; and, b) at least one high pressure misting nozzle connected to the length of tubing, the at least one high pressure misting nozzle comprising:

i) a nozzle stem body having a fluid inlet and a first chamber in communication with the fluid inlet;

ii) a fogger nozzle attached to the nozzle stem body, the fogger nozzle having a nozzle orifice and a second chamber in communication with the nozzle orifice and the first chamber;

iii) a valve member movably located in the first chamber and movable between a closed position preventing fluid communication between the fluid inlet and the first chamber, and an open position allowing fluid communication between the fluid inlet and the first chamber, whereby fluid may enter the first and second chambers; and, iv) a nozzle pin having a longitudinal axis and removably located in the second chamber, the nozzle pin having a fluid metering portion and being movable along the longitudinal axis between a first position in which the nozzle pin is displaced away from the nozzle orifice, and a second position in which the nozzle pin is located adjacent to the nozzle orifice, whereby fluid entering the second chamber urges the nozzle pin toward the second position, the nozzle pin being generally cylindrical in configuration having first and second ends, and wherein the fluid metering portion comprises at least one fluid metering notch located in the first end, such that, when fluid within the tubing reaches a predetermined pressure, the valve member moves to the open position, the fluid within the second chamber moving the nozzle pin to the second position such that the fluid is atomized as it passes through the nozzle orifice, the evaporation of the atomized fluid cooling the air entering the enclosure; and, v) a helical coil spring acting on the valve member, the helical coil spring having a first end with a cross member extending at least partially along a diameter of the helical coil spring, whereby the nozzle pin rests on the cross member when in the first position.

* * * * *